United States Patent [19]

Phillips

[11] 4,106,429

[45] Aug. 15, 1978

[54] AIR KNIFE WITH ADJUSTABLE LIP

[75] Inventor: Irvin J. Phillips, South Beloit, Ill.

[73] Assignee: Beloit Corporation, Beloit, Wis.

[21] Appl. No.: 799,504

[22] Filed: May 23, 1977

[51] Int. Cl.[2] ..... B05C 11/06

[52] U.S. Cl. ..... 118/63; 118/413; 425/466

[58] Field of Search ..... 118/63, 413; 15/316, 15/405, 306 R, 306 A; 425/466, 381; 427/348, 349; 239/593, 597

[56] References Cited

U.S. PATENT DOCUMENTS

| | | | |
|---|---|---|---|
| 1,443,324 | 1/1923 | McGovern | 425/466 |
| 3,249,965 | 5/1966 | Hannis | 425/466 X |

FOREIGN PATENT DOCUMENTS

| | | | |
|---|---|---|---|
| 2,263,714 | 8/1973 | Fed. Rep. of Germany | 118/63 |
| 537,374 | 6/1941 | United Kingdom | 118/413 |

*Primary Examiner*—Dorsey Newton

*Attorney, Agent, or Firm*—Dirk J. Veneman; Michael L. Gill; Gerald A. Mathews

[57] ABSTRACT

An air knife having at least one lip which is slidable relative to its body via a plurality of cam plugs which are interposed between the slidable lip and the body member to adjustably extend and locate the lip tip relative to the other lip tip periodically as the lips become worn and the gap between them increases. The adjustable lip is secured to the body member by a plurality of cap screws which alternate with the cam plugs across the width of the air knife.

2 Claims, 6 Drawing Figures

AIR KNIFE WITH ADJUSTABLE LIP

BACKGROUND OF THE INVENTION

This invention relates to an improved air knife such as is used, for example, in coating a traveling paper web. It is very important that the gap between the lips defining the air knife orifice be accurately maintained at a uniform distance across the entire width of the orifice. Since the gap is normally quite narrow (i.e. about 0.030 inch), such factors as small deflections of the lips, layers of built-up coating from the coating operation and material removed from the lips when cleaning them, can cause relatively great changes in the orifice gap. This is detrimental to the function of the air knife which is to direct a steady, uniform jet of air against a freshly coated web to evenly meter and smooth the coating on the web across its entire width.

A problem typical of prior air knives is that they were constructed with adjustable screws extending within the body member between their lips. This necessitated the air to flow around the adjusting screws before leaving the slotted orifice. Such an arrangement is shown in U.S. Pat. No. 2,139,628. The adjustment screws caused some interruption or turbulence in the stream of air leaving the orifice across the air knife width.

Another problem ancillary to the prior design, which in essence is still being used, relates to the manner in which the gap between lips is adjusted to remain constant in the cross machine direction. Over a period of time, coating builds up on the lips and is removed by scraping. This produces slight deformities on the surfaces of the lip tips which is compensated for by tightening the adjustment screws extending between the lips. Eventually, the lips become warped from the constant forces exerted by the adjustment screws. In addition, after repeated adjustments, the threaded contact between the screws and their mounting in the lips becomes loose which makes it more difficult than ever to maintain the lip gap within predetermined limits. At the final stages of such looseness in the threaded mountings, the lips will move rapidly enough to chatter at which time all semblance of accurate control of the lip gap vanishes.

When the lips of such prior design air knives had been worn by several scrappings and deformed by continued tightening of the adjustment screws on the top lip, they had to be disgarded because they could not be refinished and still maintain the orifice gap within the desired dimensions across the width of the air knife. This is both costly and time consuming since the lips, then as now, are made of stainless steel and must be accurately machined and finished.

Still another problem with such prior air knife designs relates to the fact that the top lip had to be slotted in order to permit both lateral and pivotal adjustment to adjust the gap relative to the stationary lower lip. Even though washers were positioned over the slots, some air would inevitably leak past to mix with the coating material and cause misting.

SUMMARY OF THE INVENTION

This air knife has at least one lip which is adjustably mounted to slide on the air knife body and be positioned by a plurality of cam plugs. The lower lip is also designed to be slidably extended, such as by screws extending through slots in the lip, but is not necessarily equipped with cam plugs. Each of the cam plugs operates in the same manner. The cam plugs are aligned along the length of the air knife body which, in operation, extends the width of the coater. The lip is positionable by the cams without requiring any screws or other mounting members to extend between the lips within the air knife body and thereby interfere with the flow of air from the slotted orifice. In addition, the movable lip is not pivoted so it is not deformed by the force of any adjustment screws.

Since each relatively small section across the width of the movable lip is accurately positionable by the cams, it can be cleaned, scraped or refinished many times while maintaining the gap spacing within desired dimensional limits across the width of the air knife. In addition, the lip can be designed with a wear resistant tip that would require less adjustment and refinishing over a period of time.

If desired, both lips can be made adjustable by cam plugs. This will increase the initial cost, but will also greatly increase the life and adjustability of the lips.

No slots extend through the walls of the air knife, thereby precluding the possibility of misting.

Adjustment is strictly by lateral movement of the lip (either top or bottom lip) relative to the body member, so no bending of the lip is required. Further, the cam positioned lip is secured to the body member by screws which are not associated with the cam plugs so there is less opportunity for the threaded connections to become loosened when the lip position is adjusted.

Accordingly it is an object of this invention to provide an air knife having at least one cam adjustable lip.

Another object of the invention is to provide an air knife having an adjustable lip, but which requires no lip adjusting or mounting structure which interferes with the passage of air out of the slotted orifice.

Another object is to provide an air knife having an adjustable lip which can be cleaned, scrapped and adjusted many more times, compared to prior air knife lips, before it needs to be replaced.

An advantage of this invention is the uniformity in the stream of air emitted from the slotted orifice.

Other objects, features and advantages of the invention will become apparent to those skilled in the art when the figures are observed in conjunction with the description of the preferred embodiment.

DESCRIPTION OF THE PREFERRED EMBODIMENT

Figure 1:
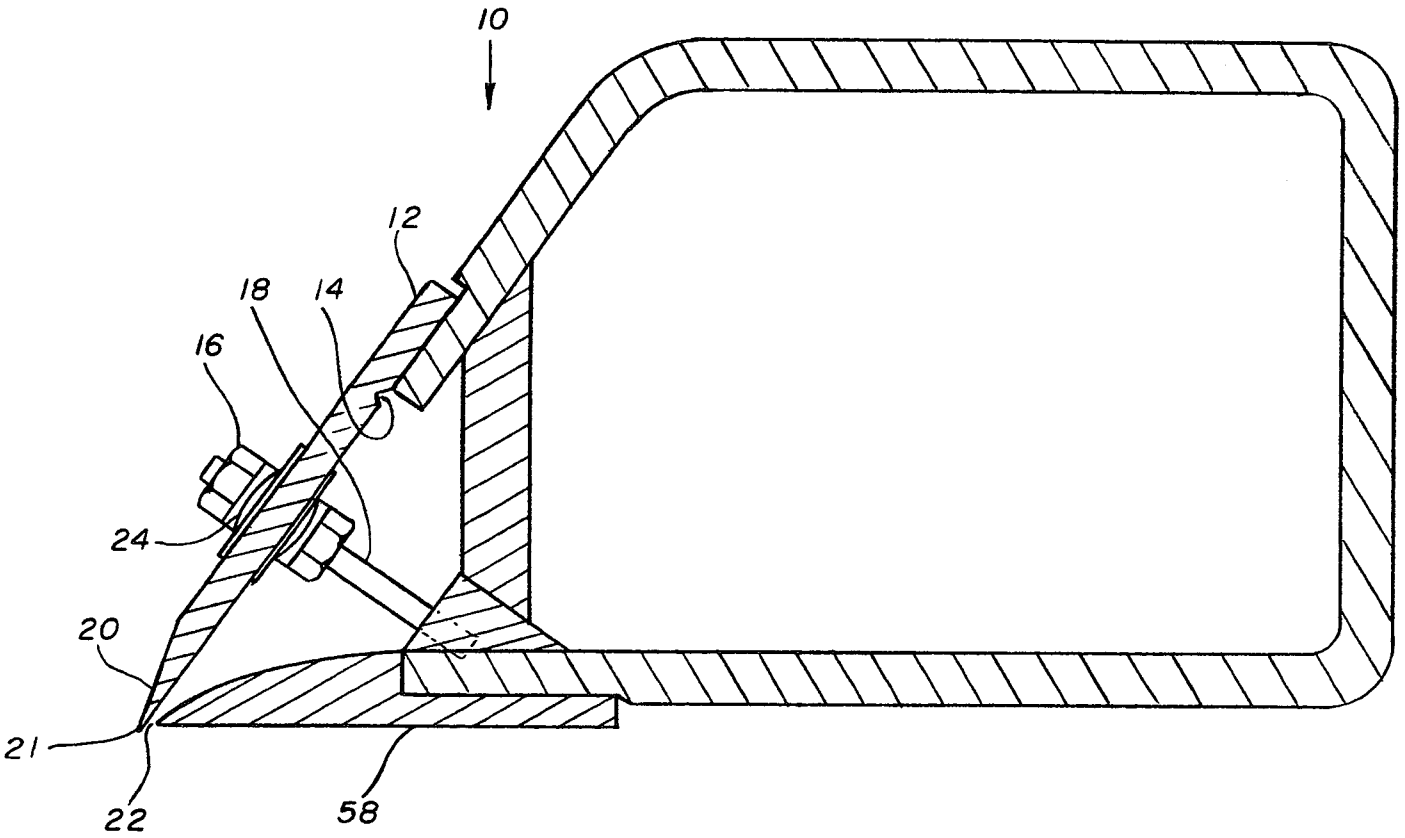
FIG. 1 (PRIOR ART)
FIG. 1 is a cross section side elevational view of a prior art air knife showing the pivotable top lip with the mounting and adjustment screws extending through the body between the lips.

The prior art air knife as shown in FIG. 1, serves to clearly illustrate the distinctions and advantages of this invention. In the prior style of air knife 10, the top lip 12 is initially notched at 14 so that the force applied on it by the nuts 16 on adjusting screws 18 pivot and bend it at a known location 14 when adjusting the gap 22 as it extends across the width of the air knife. The term "width" as used here refers to the long, axial dimension of the air knife which extends parallel to the tip edge 21 of its lip 12. Since the air knife extends transversely across the traveling web as it is being coated, the "width" of the air knife extends across the width of the traveling web.

Air emitting from orifice gap 22 must pass over the adjusting screws 18 which are spaced at about 4 inch centers along the width of the air knife. This interrupts the continuity of the air stream which means the smoothing and metering action of the air against the freshly coated web may not be as uniform as desired.

Paper coating material contains abrasives such as titanium dioxide and clay. In a paper making machine with an on-machine coater, sheet breaks often cause the sheet (which might be paper board) to wad up or lash out in whip-like action. This causes the paper to strike the lip tip 20 with considerable force which can cause nicks and distortions in the lip tip and edge 21. In addition, the lip tip 20 gradually becomes incrusted with coating material over a period of time. About once a month, therefore, it needs to be removed for cleaning and refinishing.

As the lip tip is worn away in the refinishing process to make it straight and smooth, the notch 14 is moved further down towards the tip. Subsequent adjustments of nuts 16 on screws 18 therefore tend to bend the top lip in a position more in the middle of the lip which tends to accentuate distortion at the top lip tip 20.

This dual bending and lateral movement of the top lip is necessary to correct for distortions in the lower, stationary lip also. There are slots in the top lip 12 which allow the refinished lip to be relocated down further toward the orifice gap 22. When the notch 14 shifts downwardly as the lip is periodically refinished, the slots are more difficult to cover with curved washer 24 and the escaping air mixes with the coating material in the immediate vicinity to cause misting. This misting impairs the quality of the coated paper it contacts.

Figure 2:
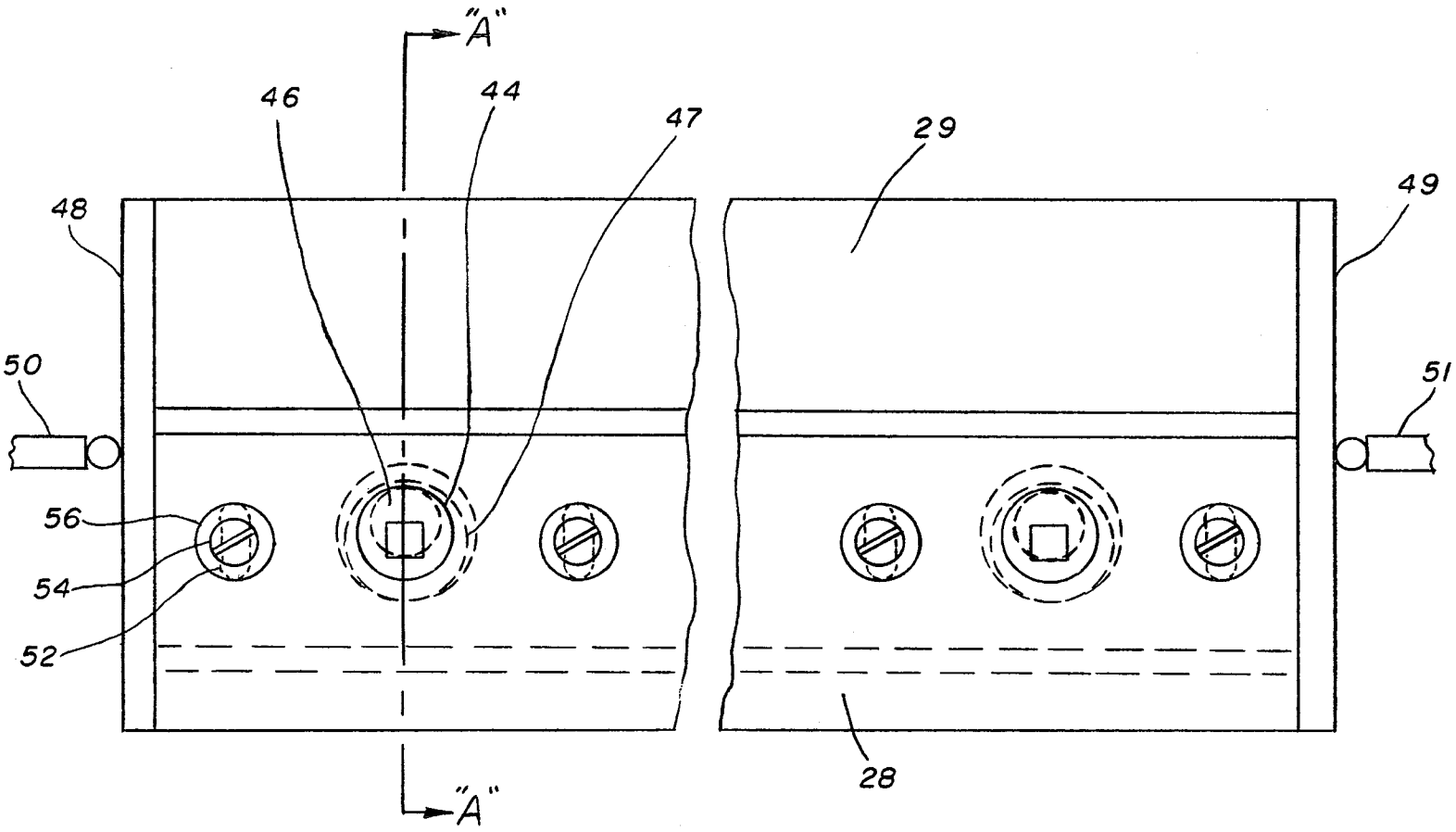
FIG. 2 is a plan view of the air knife of this invention showing the cam plugs and screws securing the lip onto the body.
Figure 3:
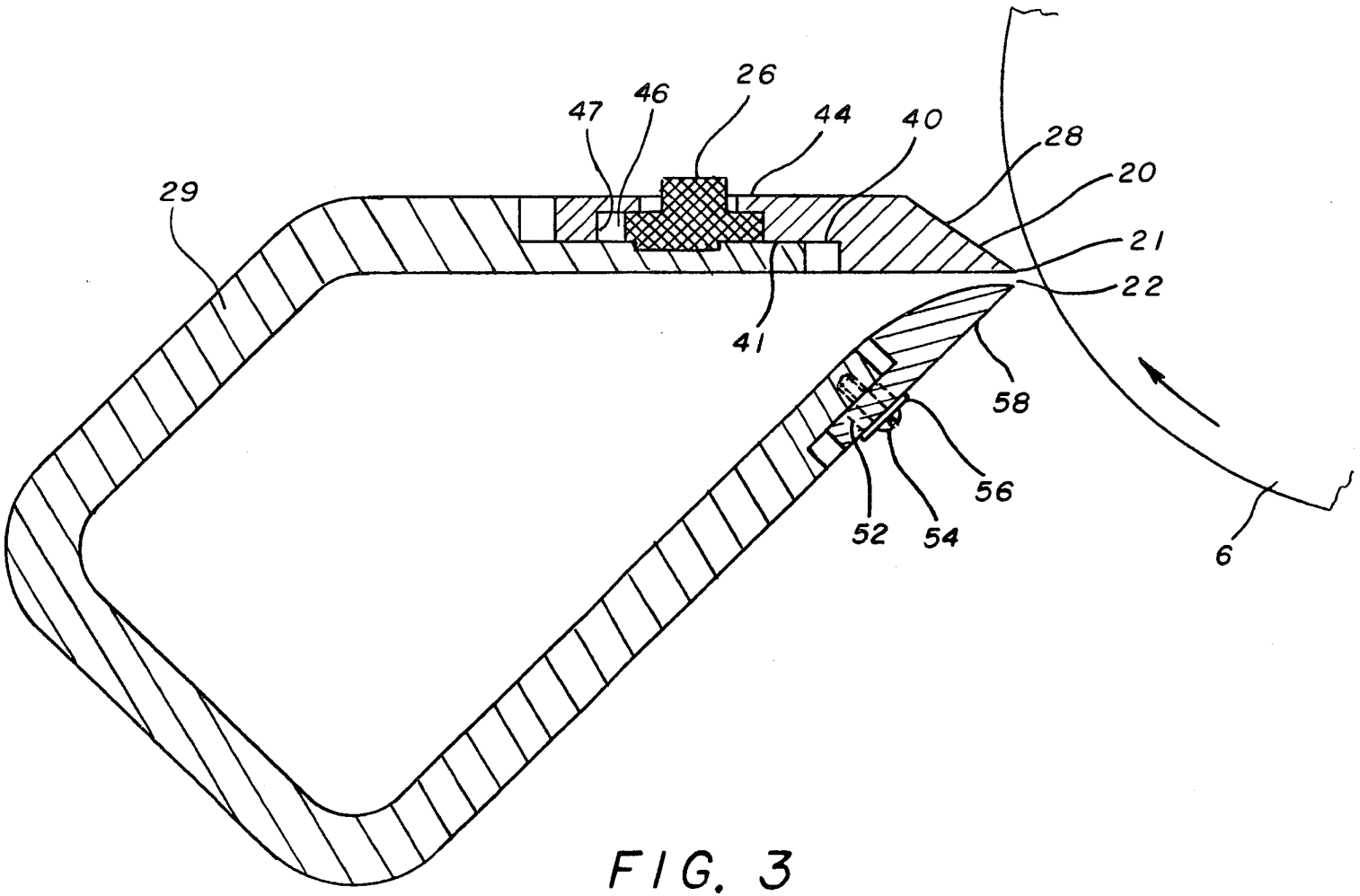
FIG. 3 is a cross section side elevational view of the air knife through section "A"—"A" in FIG. 2.
Figure 4:
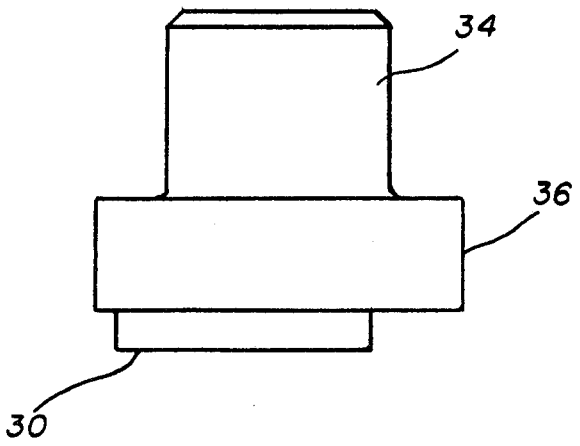
FIG. 4 is an elevational view of a cam plug.
Figure 5:
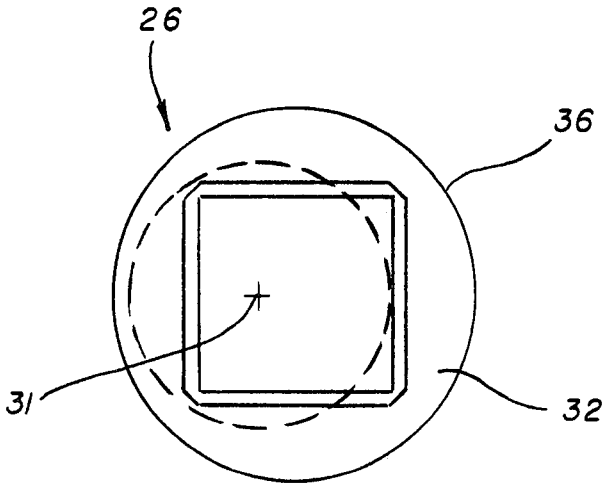
FIG. 5 is a top view of the cam plug shown on FIG. 4.

As shown in FIGS. 2 and 3, the air knife of this invention utilizes a plurality of cam plugs 26 which are positioned between the top lip 28 and the body member 29. Edge 21 is positioned adjacent rotating roll 6. The cam plug 26 is more clearly shown in FIGS. 4 and 5. A cylindrical pilot hub 30 extends beneath a cylindrical flange 32. A cap 34 having many sides extends above the flange 32 on the opposite side from the pilot hub to enable a wrench to be applied to turn the cam plug. Cap 34 is concentric with flange 32, but hub 30 is offset so that rotation about its axis of rotation 31 causes the cylindrical cam surface 36 on the peripheral edge of flange 32 to define a path which reciprocates as a cam plug is turned.

Referring again to FIGS. 2 and 3, cam plug 26 is rotatably mounted in the air knife body member 29. Top lip 28 has a surface 40 which is adapted to slide over a corresponding surface 41 on body member 29. A cylindrical recessed opening 46 is formed in the underside of the top lip. This opening does not extend through the top lip, but stops short to form an inwardly extending rim 44 which prevents the cam plug from coming out when the top lip is positioned over the body member 29. Cap 34 extends through rim 44 above the top lip surface. Cylindrical opening 46 is of a diameter slightly larger than the longest radial distance of cam surface 36 from the axis of rotation 31 of cam plug 26 (FIG. 5) so that the cam plug can be rotated in a complete circle within opening 46 is desired. This configuration also permits the top lip to be moved forwards toward the orifice gap 22 without moving it sideways.

The ends of the air knife are plates 48, 49 which are held in place by toggle arms shown generally at 50, 51. These end plates and toggle arms as well as the means for supplying air to the air knife form no part of the invention and will not be discussed further in detail.

Alternating with the cam plugs along the width of the air knife body are a plurality of screws 54, each of which passes through a corresponding slot 52 in the top lip 28. Slots 52 extend toward and away from orifice gap 22 to permit the top lip to slide toward gap 22 via surfaces 40, 41 when its tip 20 has been shortened during cleaning and refinishing. A washer 56 is positioned over each slot 52. Since the slots 52 are located over that portion of the body member extending immediately beneath, and the tapped holes for screws 54 do not extend through body member 29, no air escapes past slots 52 to cause misting.

Figure 3A:
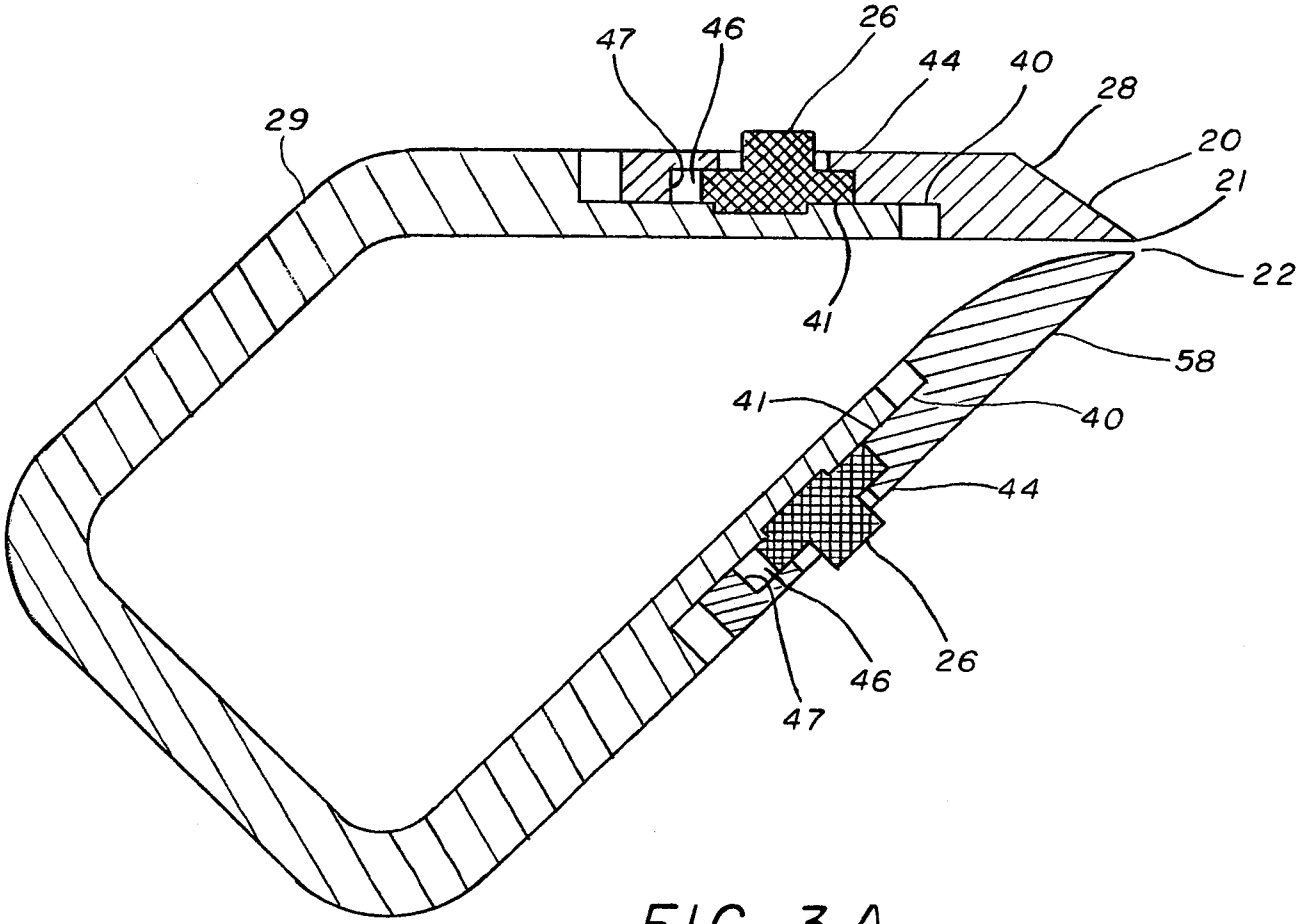
FIG. 3A is a cross section side elevational view similar to FIG. 3, but showing both top and bottom lips being locatable by cam plugs.

A bottom lip 58 cooperates with top lip 28 to form the orifice gap 22 which extends the width of the air knife. Bottom lip 58 is shown with screws 54 mounting it to the air knife body through slots 52 in the same manner as the screws 54 secure the top lip. FIG. 3A shows both top and bottom lips 28, 58 positionable by cam plugs and secured by screws in identical manner. This orifice gap is commonly set at about 0.030 0.045 inch, but may vary depending on the conditions of operation.

When the gap 22 needs adjustment, screws 54 are loosened. A wrench is then applied to cap 34 to turn a cam plug 26. The cam surface 36 bears against the inner cylindrical pressure surface 47 of opening 46 to urge the top lip 28 to slide toward the orifice gap 22. A feeler gage is used to determine the proper gap at each point along the width. This procedure is started at the middle of the air knife and proceeds outwardly with cam plugs in both directions.

This gap adjustment procedure is delicate, but greatly facilitated by the cam plugs which operate to smoothly change the gap spacing and accurately locate the tip edge 21 at each position across the air knife width. If only one lip is cam positioned, it might be characterized as being accurately adjustable while the other lip would then be comparatively characterized as being coarsely adjustable.

The gap spacing is influenced by other factors besides wear. The beam deflection across the width of the air knife causes some differences in the gap spacing at different locations along the span. Thus, independent of wear, the cam plugs can easily compensate for slight local differences in the gap spacing caused by deflection. As each cam plug adjusts the gap in its vicinity to the desired setting, the adjacent screws are initially lightly tightened to secure the top lip in place until uniform gap established over entire width is then securely tightened.

The gap can thus be adjusted many times to compensate for much wear since the top lip merely slides along the surface 41 of the body member and is not required to pivot or be bent by adjustment screws. The lower lip 58 need only be extended by loosening screws 54, if it is not equipped with cam plugs. Fine adjustment of the orifice gap spacing can then be done by the cam plugs on the top lip. If both lips are cam positioned to locate their lip tip edges (FIG. 3A), the gap adjustment procedure is the same for each lip. The amount of material that can be removed from the lip tip is only limited from a practical standpoint by the distance the lip can be moved forward by the cam action of the cam plugs. It is possible that the lip tip can be made of a hard, wear resistant material, such as a ceramic, which would eliminate refinishing operations and merely require replacement of lip if damaged.

What is claimed is:

1. In an air knife having a body member and a pair of lips defining an orifice gap, the improvement comprising:

at least one of the lips being adjustable and having a. a surface slidably movable on the body member, b. a plurality of slots, each of the slots extending to permit lip movement toward the orifice gap, c. a plurality of circular pressure surfaces, d. a plurality of rims extending about the pressure surfaces;

a plurality of cam plugs, each having a circular cam surface of smaller diameter than the circular pressure surfaces and mounted in the body member with their cam surfaces engaging the pressure surfaces and held in position between the lip and body member by a corresponding rim whereby turning movement of the cam plugs urges the lip to move relative to the body member;

a plurality of screws extending through the slots in the movable lip and mounted in the body member whereby the movable lip is selectively secured relative to the body member upon being positioned by the cam plugs.

2. The air knife as set forth in claim 1, wherein:

each of the lips is adjustable and has a. a surface slidably movable on the body member, b. a plurality of slots, each of the slots extending to permit lip movement toward the orifice gap, c. a plurality of circular pressure surfaces;

a plurality of cam plugs, each having a circular cam surface of smaller diameter than the circular pressure surfaces and mounted in the body member with their cam surfaces engaging the pressure surfaces of each lip whereby turning movement of a cam plug urges the corresponding lip to move relative to the body member and orifice gap;

a plurality of screws extending through the slots in the lips and mounted in the body member whereby the lips are selectively secured relative to the body member, each other and the orifice gap upon being positioned by the cam plugs.

* * * * *